US005272782A

United States Patent [19]

Hutt

[11] Patent Number: 5,272,782

[45] Date of Patent: Dec. 28, 1993

[54] MULTI-PURPOSE PAINTER TOOL

[76] Inventor: Heinz Hutt, 9140 Cérès Street, Pierrefonds, Canada, H3Y 3N7

[21] Appl. No.: 999,119

[22] Filed: Dec. 31, 1992

[51] Int. Cl.[5] ..... A47L 25/00; A47L 13/02

[52] U.S. Cl. ..... 15/105; 15/142; 15/236.01; 15/236.03; 7/170

[58] Field of Search ..... 15/105, 142, 236.03, 15/236.01; 7/105, 169, 170

[56] References Cited

U.S. PATENT DOCUMENTS

| | | | |
|---|---|---|---|
| 2,564,721 | 8/1951 | Raya | 15/142 |
| 2,825,916 | 3/1958 | Basala, Jr. | 15/236.03 |
| 2,856,622 | 10/1958 | Jacobsen | 15/105 |
| 3,170,182 | 2/1965 | Burian | 15/142 |
| 3,774,252 | 11/1973 | Cantales | 7/105 |
| 4,324,018 | 4/1982 | Olsson | 15/105 |
| 5,020,181 | 6/1991 | Leonard | 7/170 |

FOREIGN PATENT DOCUMENTS

| | | | |
|---|---|---|---|
| 2721212 | 11/1978 | Fed. Rep. of Germany | 15/236.03 |

*Primary Examiner*—Chris K. Moore
*Assistant Examiner*—Randall E. Chin
*Attorney, Agent, or Firm*—Pierre Lespérance; Francois Martineau

[57] ABSTRACT

The tool of the invention includes an integral body having a flat scraper part, a collar part, and a comb part. The tool body is made from a resilient, yet substantially rigid material. The scraper part is to be used as a trowel by a painter. The collar part is used in axially engaging a cylindrical paint roller soaked with paint, to frictionally remove paint from the paint roller as the collar part is displaced from one end to the opposite end of that paint roller. The comb part is used to clean the bristles of a paint brush, by transversely engaging same and lengthwisely sliding or "combing" the bristles to remove paint after the paint job is completed.

4 Claims, 2 Drawing Sheets

MULTI-PURPOSE PAINTER TOOL

FIELD OF THE INVENTION

This invention relates to the field of hardware store implements, particularly those associated with painting tools.

BACKGROUND OF THE INVENTION

Professional painters as well as lay painters need a set of different tools, to help them in their work. Having to carry and reach out for these tools each time they are required, is both cumbersome and inefficient.

OBJECT OF THE INVENTION

The main object of the invention is to provide a single painter's tool which can do three different jobs in alternating fashion.

SUMMARY OF THE INVENTION

Accordingly with the object of the invention, there is disclosed a multi-purpose painter's tool consisting of an integral main body having a scraper member, a collar member, and a comb member, wherein: (a) said tool body is made from a resilient, semi-rigid material; (b) said scraper member defines a handle section and a free end scraping edge section, said scraping edge section to be used as a trowel by a painter; (c) said collar member merges with said handle section of the scraper member, said collar member being usable in axially engaging a cylindrical paint roller soaked with paint, for frictionally purging paint from the paint roller bristles as the collar member is displaced from one end to the opposite end of that paint roller; and (d) said comb member is carried by said tips tangentially of said collar member and is to be used in cleaning the bristles of a paint brush, by transversely engaging the latter and lengthwisely combing the bristles to remove paint after the paint job is completed.

DETAILED DESCRIPTION OF THE INVENTION

Figure 1:
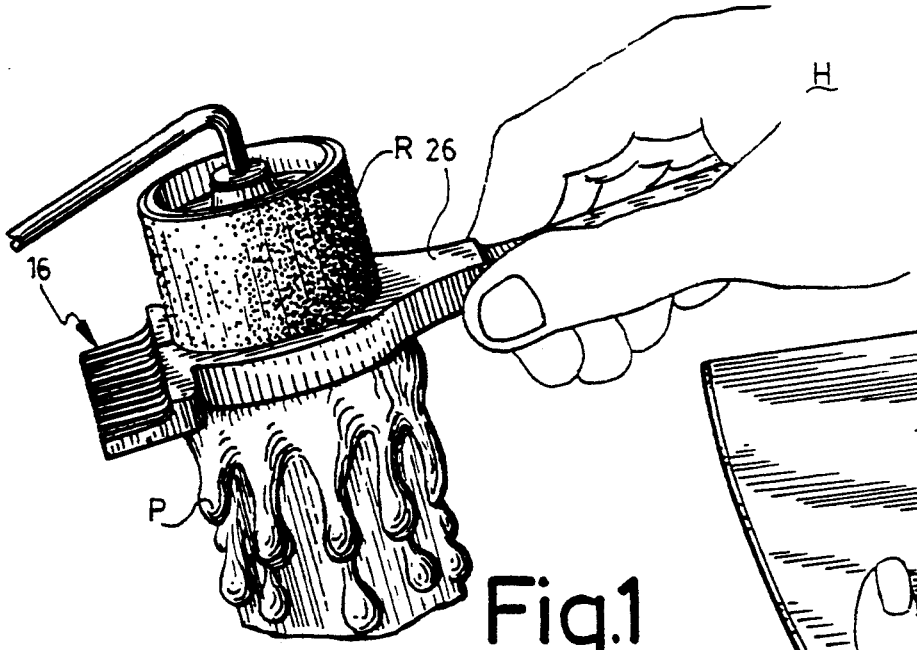
FIG. 1 is a perspective view of a preferred embodiment of painter tool in accordance with the teachings of the invention, suggesting how the collar part of the tool can be used in axially purging (liquid) paint from a cylindrical paint roller soaked with paint.
Figure 3:
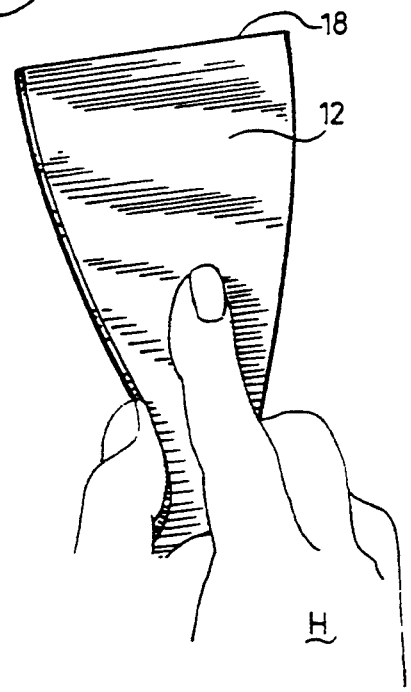
FIG. 3 is an isometric view of the scraper part of this tool.

The tool 10 includes an integral body having a flat scraper part 12, a collar part 14 and a comb part 16. Preferred materials include nylon, polypropylene and polyethylene. The tool should be substantially rigid, yet retain some resilient flexibility.

The scraper part 12, at one end of elongated tool 10, forms a flat sheet, define an end edge 18 and two lateral side edges 20 and 22. End edge 18 is straight, sharp, and extends transversely of the lengthwise axis of tool 10. Side edges 20 and 22 are generally convex. The width of scraper part 12 increases from its inner end to its outer end free edge 18, but its thickness tapers from a thicker inner end to a thinner outer free end 18. This thicknesswise taper provides better flexibility of the scraper at its outer free end portion 18.

Scraper part 12 is to be used as a trowel by a painter. Of course, other uses are also envisioned, for example, as a frost removing ice scraper for car windshields.

Figure 4:
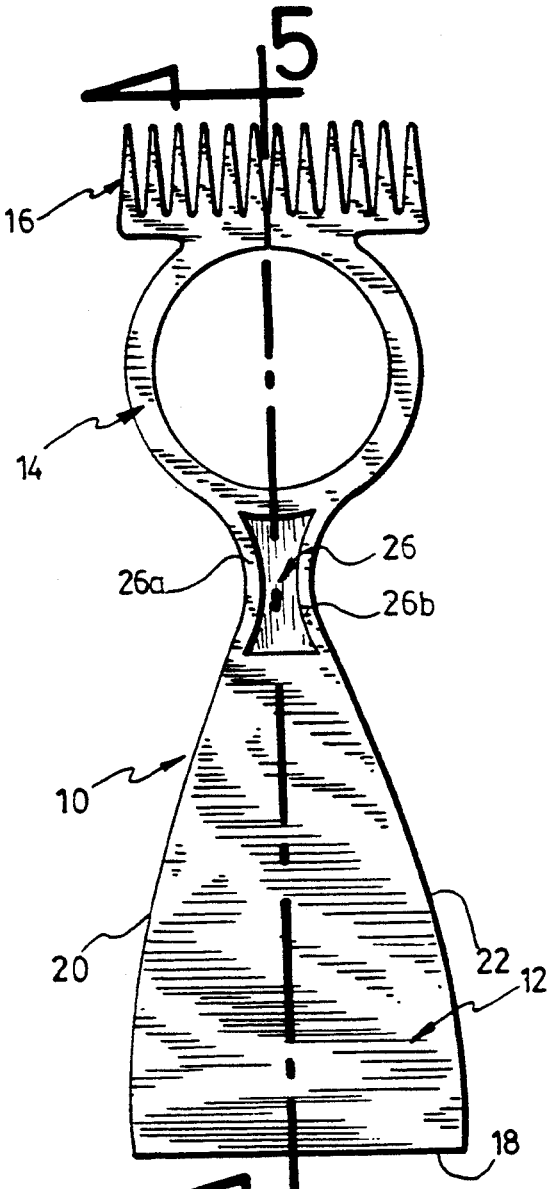
FIG. 4 is a plan view of the tool of FIG. 1.
Figure 5:
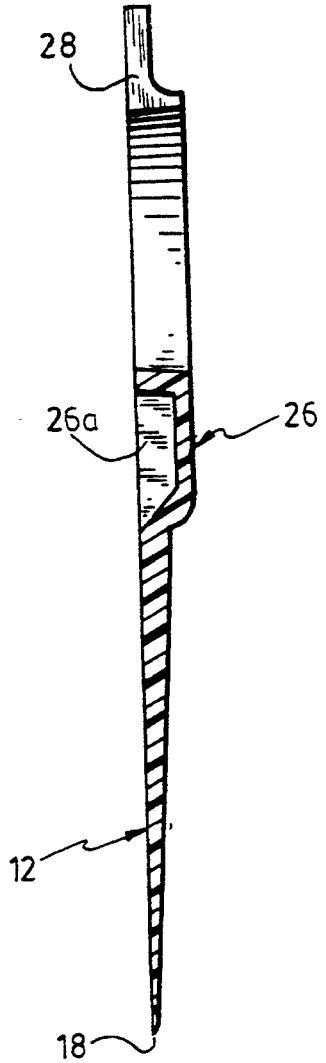
FIG. 5 is a sectional view along line 5—5 of FIG. 4.
Figure 6:
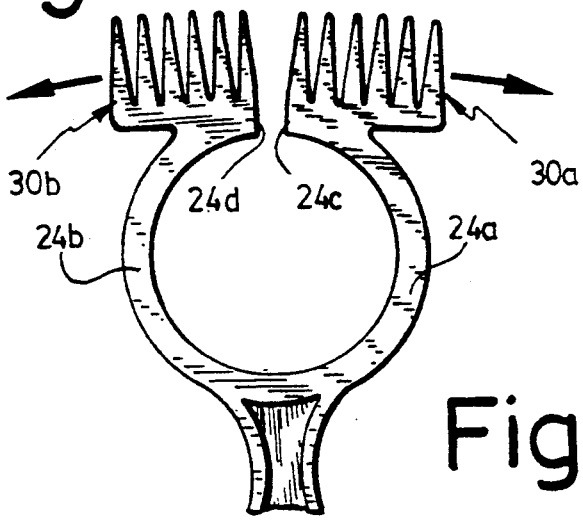
FIG. 6 is a view of the upper portion of FIG. 4, suggesting how the two jaws of the tool collar part can be forcibly spread apart.

Intermediate collar part 14 is integrally connected to trowel 12 by a narrow shaft extension 26. Shaft 26 is thicker than trowel 12. Shaft 26 has concavo-concave lateral side edges 26*a*, 26*b*, being coextensive with the trowel side edges 20 and 22 respectively. Collar member 14 is transversely sectioned at its outer end about slit 28, to form two lateral wings 24*a*, 24*b*, which may be spread apart at their outer ends (FIG. 6) upon forcible bias being applied at their free end tips 24*c*, 24*d*, yet the collar 14 will automatically resume its original closed condition (FIG. 4) when the forcible bias is released, due to the inherent spring-back nature or resiliency of the selected material constituting the tool.

Collar 14 is to be used in axially engaging a cylindrical paint roller R soaked with paint P, to frictionally remove paint from the paint roller R as the collar 14 is displaced from one end to the opposite end of that paint roller R. It is understood that by virtue of the adjustable inner diameter of collar 14 described hereinabove, collar 14 will diametrically adapt to cylindrical paint rollers R having bristles of various thicknesses (whereby the total effective paint roller diameter varies accordingly).

Comb part 16 consists of two generally coextensive comb members 30*a*, 30*b*, tangentially carried at the outer end of the two lateral wings end tips 24*c*, 24*d*, of collar 14. Due to the resiliency of the tool material, collar 14 is normally closed in unbiased condition, wherein comb members 30*a*, 30*b* abut endwisely coextensively against one another.

Figure 2:
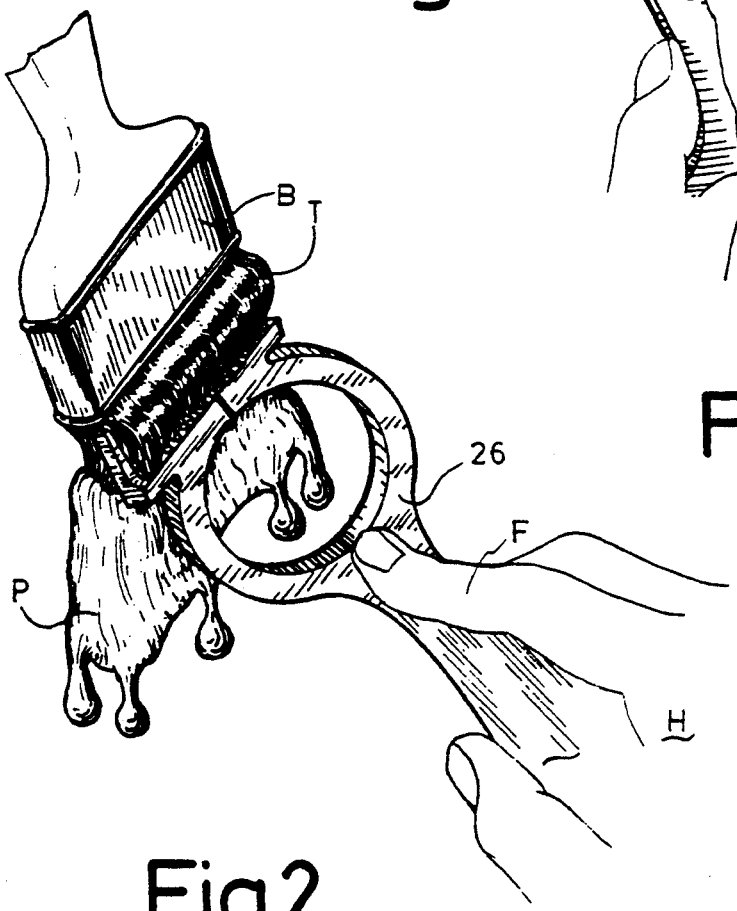
FIG. 2 is a perspective view of the present tool, suggesting how the comb part thereof can be alternatively used to purged paint-loaded bristles from a standard paint brush.

Comb 16 is used to clean the bristles T of a paint brush B, by transversely engaging same and lengthwisely sliding or "combing" the bristles T to remove paint P after the paint job is completed. As suggested in FIG. 2, flat part 26 of tool 10 advantageously constitutes a leveraging bearing surface for the forefinger F from the hand H of a user, with the hand palm surrounding the handle 12. Alternate uses for comb 16 include breaking and/or fragmenting ice on a motor vehicle windshield in subfreezing temperatures.

I claim:

1. A multi-purpose painter's tool consisting of an integral main body having a scraper member, a collar member, and a comb member, wherein:

(a) said tool body is made from a resilient, semi-rigid material;

(b) said scraper member defines a handle section and a free end scraping edge section, said scraping edge section to be used as a trowel by a painter;

(c) said collar member merges with said handle section of the scraper member, said collar member being usable in axially engaging a cylindrical paint roller soaked with paint, for frictionally purging paint from the paint roller bristles as the collar member is displaced from one end to the opposite end of that paint roller, wherein said collar member further defines a pair of arcuate jaws, each one of said jaws defining an inner end merging with said handle section and an opposite free end tip; the two tips being endwisely biased abuttingly against one another under the resiliency of said main body material, yet being forcibly temporarily movable away from one another, whereby said collar member is of adjustable inner diameter; and (d) said comb member is carried by said tips tangentially of said collar member and is to be used in cleaning the bristles of a paint brush, by transversely engaging the latter and length wisely combing the bristles to remove paint after the paint job is completed.

2. A multiple-purpose painter's tool as defined in claim 1, wherein said comb member consists of two comb half sections each carried by a corresponding one of said tips tangentially of said collar member, said comb half sections becoming coextensive to one another when said tips abut against one another.

3. A multiple-purpose painter's tool as in claim 2, wherein said scraper member is flat and tapers in width toward said collar member.

4. A multiple-purpose painter's tool as defined in claim 2, wherein said scraper member is generally flat but tapers in thickness toward said free end section thereof.

* * * * *